US007178707B1

(12) United States Patent
Bokina

(10) Patent No.: US 7,178,707 B1
(45) Date of Patent: Feb. 20, 2007

(54) SURGICAL TAPE DISPENSER

(76) Inventor: Sheila Bokina, 2606 Willow Pond Rd., Riverhead, NY (US) 11901

( * ) Notice: Subject to any disclaimer, the term of this patent is extended or adjusted under 35 U.S.C. 154(b) by 271 days.

(21) Appl. No.: 10/761,921

(22) Filed: Jan. 19, 2004

(51) Int. Cl.
*B65H 16/06* (2006.01)
*B65H 16/08* (2006.01)
*B65H 35/07* (2006.01)

(52) U.S. Cl. ..... 225/38; 225/34; 225/41; 225/42; 225/47; 225/53; 225/77; 242/594.4; 242/594.6; 242/598

(58) Field of Classification Search ..... 225/34, 225/36, 37, 38, 39, 40, 41, 42, 43, 47, 53, 225/77; 83/650; 242/594, 594.4, 594.5, 242/594.6, 598
See application file for complete search history.

(56) References Cited

U.S. PATENT DOCUMENTS 1,358,904 A * 11/1920 Welch ..... 225/38
2,109,379 A * 2/1938 Brown ..... 242/594.6
2,154,440 A * 4/1939 Crotts ..... 242/594.5 X
2,304,312 A * 12/1942 Meglitz ..... 225/47
2,647,700 A 8/1953 Lathrop
3,199,394 A 8/1965 Castelli
3,856,230 A * 12/1974 Zimmer ..... 242/422.8
3,870,211 A 3/1975 Schriever
4,648,530 A * 3/1987 Granger ..... 221/34
4,775,109 A 10/1988 Tegg
4,872,601 A * 10/1989 Sigmund ..... 225/38
5,160,077 A 11/1992 Sticklin
5,618,008 A * 4/1997 Dearwester et al. ..... 242/594.5
5,720,447 A * 2/1998 Brechko ..... 242/563.1
5,954,256 A 9/1999 Niada
6,047,920 A * 4/2000 Dearwester et al. ..... 242/594.5
6,056,233 A 5/2000 Von Schenk
6,364,245 B1 4/2002 Paal et al.
2002/0121537 A1 9/2002 Petterson et al.

* cited by examiner

*Primary Examiner*—Clark F. Dexter
(74) *Attorney, Agent, or Firm*—Michael I. Kroll

(57) ABSTRACT

The present invention 10 discloses a tape dispenser having a plurality of spindles 26 that will hold various width tape rolls 14 within a housing 30 containing compartments for the tape rolls. The housing 30 is comprised of a rigid material having a plurality of grooves 28 on opposing walls of the housing for axially mounting spindles 26 holding tape rolls 14 therewith. There are serrated members 20 extending from the housing 30 enabling tape to be sheared into any length needed. Cover 16 also has pivots 22 and a locking element 24.

5 Claims, 8 Drawing Sheets

SURGICAL TAPE DISPENSER

BACKGROUND OF THE INVENTION

1. Field of the Invention

The present invention relates generally to tape dispensers and, more specifically, to a tape dispenser having a plurality of spindles that will hold various width tape rolls within a housing containing compartments for the tape rolls. The housing is comprised of a rigid material having a plurality of grooves on opposing walls of the housing for axially mounting spindles holding tape rolls therewith. There are serrated members extending from the housing enabling tape to be sheared into any length needed.

2. Description of the Prior Art

There are other dispenser devices designed for rolled tape. Typical of these is U.S. Pat. No. 2,647,700 issued to Lathrop on Aug. 4, 1953

Another patent was issued to Castelli on Aug. 10, 1965 as U.S. Pat. No. 3,199,394. Yet another U.S. Pat. No. 3,870,211 was issued to Schriever on Mar. 11, 1975 and still yet another was issued on Oct. 4, 1988 to Tegg U.S. Pat. No. 4,775,109.

Another patent was issued to Sigmund on Oct. 10, 1989 as U.S. Pat. No. 4,872,601. Yet another U.S. Pat. No. 5,160,077 was issued to Sticklin on Nov. 3, 1992. Another was issued to Niada on Sep. 21, 1999 as U.S. Pat. No. 5,954,256 and still yet another was issued on May 2, 2000 to Von Schenk as U.S. Pat. No. 6,056,233.

Another patent was issued to Paal, et al. on Apr. 2, 2002 as U.S. Pat. No. 6,364,245. Yet another U.S. Patent Publication No. 2002/0121537 was issued to Petterson, et al. on Sep. 5, 2002.

U.S. Pat. No. 2,647,700

Inventor: Harvey Lathrop

Issued: Aug. 4, 1953

The combination with a dispensing spool of adhesive tape comprising a hub and a tangential projection eccentric to the hub to support the free end of the tape, of a supporting enclosure comprising a pair of parallel vertical walls, means carried by said walls for engaging the spool hub to support the latter in a horizontal disposition and for free rotation about its axis, transverse walls extending between said vertical walls to form an enclosure closed on all sides but one, the open side lying in a single plane so that the enclosure may be rested thereon to conceal said spool, the transverse wall adjacent to said open side being flat so that the enclosure may be optionally rested on said flat wall to bring the open side into upright position and thereby expose and afford access to said spool, said spool being supported with its tangential projection downward and facing away from said flat wall when the enclosure is in the spool concealing position, whereby the eccentricity of said projection automatically causes it to protrude out of said open side of the enclosure when the enclosure is rested on said flat wall.

U.S. Pat. No. 3,199,394

Inventor: Charles Castelli

Issued: Aug. 10, 1965

In a tape dispenser a pair of end sections disposed parallel to each other, each end section having a rear portion and a front portion, a cutter guide extending between and secured to the front portions of said end sections, a tape container comprising a body section, a cover and the rear portions of said, end sections, a hinge connecting said cover to said body section, a plurality of spacers in said body section for positioning rolls of tape placed in said container, said spacers having slots therein for removably supporting a spindle thereon, means carried by said cover for maintaining said spindle in said slots when said cover is in a closed position, and a cutter movable along said cutter guide for severing sections of tape.

U.S. Pat. No. 3,870,211

Inventor: Fred G. Schriever

Issued: Mar. 11, 1975

A multiple tape dispenser comprising, a cylindrical housing having a plurality of reels of tape rotatably mounted in the housing and spaced apart in fixed relationship to each other, said housing having an edge over which the housed tape may be dispensed, and a cutting means affixed to the housing and located near the edge of the body member for cutting a length of desired tape at the point the tape is dispensed.

U.S. Pat. No. 4,775,109

Inventor: Duane T. Tegg

Issued: Oct. 4, 1988

A multi-compartmented toilet paper holder includes a mounting plate, which is attachable to a vertical wall. A housing pivotally engages the mounting plate to permit pivoting of the housing between open and closed positions. In one embodiment of the invention, an intermediate wall divides the interior of the housing into upper and lower compartments. In another embodiment of the invention, an intermediate wall divides the housing into side-by-side lateral compartments. Each compartment is of a size to accommodate a roll of toilet paper and each compartment has an access opening through which the paper is dispensed at the lower portion thereof.

U.S. Pat. No. 4,872,601

Inventor: Jerry A. Sigmund

Issued: Oct. 10, 1989

A wall mounted toilet tissue dispenser for two very large rolls of toilet tissue. The rolls are rotatably supported side by side in the dispenser with the axis of each roll perpendicular to the mounting wall of the dispenser. Paper is dispensed through a dispensing opening located at the bottom of the dispenser. Tail guide members are provided in the dispenser for limiting the location in the dispensing opening of the tail of each roll of tissue and for guaranteeing that the paper is at an angle to the vertical when the paper is severed so that after the paper is cut the tail will project below the dispensing opening when the paper falls to a vertical position.

U.S. Pat. No. 5,160,077

Inventor: Scott J. Sticklin

Issued: Nov. 3, 1992

An apparatus for holding, containing, and dispensing sterile, hygienic cordage, such as dental floss and suture materials is disclosed. The apparatus comprises: a housing; and cutting and retaining means. The housing has a depression formed therein across which the cordage is placed. The apparatus allows a user to grasp the cordage, withdraw a desired length of cordage, and sever a trailing end thereof without manually touching the apparatus. This reduces the threat of cross-contamination between successive uses and/or users of the apparatus.

U.S. Pat. No. 5,954,256

Inventor: Gianandrea Niada

Issued: Sep. 21, 1999

A container device that dispenses paper from a roll, with a roll (B) in reserve is disclosed. The device has two substantially parallel pins (4,4') for supporting and unwinding paper from the rolls (A, B) with two openings corresponding to the pins in the lower portion of the device contained within a housing. A sector shaped as part of a circle is mounted to freely rotate about one of the pins. The sector has a peripheral flange that is adapted to obstruct the corresponding opening. When the sector is kept at a first, substantially vertical position, the opening is obstructed. A spring urges the sector to rotate until reaching a second position at which point, the previously obstructed opening is made accessible. A lever is provided to keep the sector in a first position until a thumb follower, attached to the lever comes into contact with the core of the roll upon roll exhaustion, whereby the sector rotates to a second position making the opening accessible.

U.S. Pat. No. 6,056,233

Inventor: David R. Von Schenk

Issued: May 2, 2000

A cover system for toilet paper to protect the toilet paper from dispersal by children and pets comprising a wall-mounted plastic casing completely covering upper and lower rolls of paper. The upper and lower rolls are covered by respective upper and lower swivelable covers, each having a safety latch system. Each safety latch system includes a pair of button-releasable latches with one button on each side of the casing and each cover may be released only by pushing both such buttons at the same time. The covers are light permeable and night lights may be mounted to the inside of the casing or as part of each holder going through each toilet paper roll.

U.S. Pat. No. 6,364,245

Inventor: Alan P. Paal, et al.

Issued: Apr. 2, 2002

A dispenser for selectively dispensing first and second rolls of sheet material respectively wrapped around first and second cores is provided. The dispenser includes a housing defining a storage compartment for the first and second rolls and an opening, a first and second core support structures disposed in the housing for respectively supporting differently sized first and second cores and a divider slidably carried by the housing and covering a portion of the opening. The divider is movable between a first dispensing position, wherein a first portion of the opening is uncovered to allow access to the first roll and a second portion of the opening is covered to prevent access to the second roll, and a second position, wherein the first portion of the opening is covered and the second portion the opening is uncovered to allow access to the second roll. The divider includes an adjustable blocking plate for preventing movement of the divider from the first dispensing position to the second dispensing portion until substantially all the sheet material has been exhausted from the first roll. The plate is positionable on the divider in a plurality of positions relative to the first core support structure to compensate for different diameter cores.

U.S. Patent Publication No. 2002/0121537

Inventor: Tor Petterson, et al

Issued: Sep. 5, 2002

Dispenser for rolls of a web-shaped material, such as paper, said dispenser having space for at least two rolls arranged substantially horizontally, at which one space is located adjacent the outlet opening and is intended for a first roll in a use position and the second space is located above the first space and is intended for a roll in standby position. A locking means is intended to keep the second roll in standby position. The first space is provided with a vertically arranged disk plate having a flange intended to grip around one end of the roll and keep it in use position. The disk plate is spring-loaded and cooperates with the locking means in such a way that when a roll is located in place in the disk plate the locking means prevents the standby roll from falling down, but when the roll is removed from the disk plate the locking means can be released and permit the standby roll to fall down to use position in the disk plate.

While these dispensers may be suitable for the purposes for which they were designed, they would not be as suitable for the purposes of the present invention, as hereinafter described.

SUMMARY OF THE PRESENT INVENTION

The present invention discloses a tape dispenser having a plurality of spindles that will hold various width tape rolls within a housing containing compartments for the tape rolls. The housing is comprised of a rigid material having a plurality of grooves on opposing walls of the housing for axially mounting spindles holding tape rolls therewith. There are serrated members extending from the housing enabling tape to be sheared into any length needed. The cover also has pivots and a locking element.

A primary object of the present invention is to provide a tape dispenser having a pivoting dust cover and locking mechanism.

Another object of the present invention is to provide a housing that will hold a plurality of tape spindles.

Yet another object of the present invention is to provide a tape dispenser for holding various width tape rolls.

Still yet another object of the present invention is to provide a tape dispenser having apertures for wall mounting.

Another object of the present invention is to provide a tape dispenser having serrated members for efficiently shearing tape.

Yet another object of the present invention is to provide a contamination free environment for surgical tape rolls.

Still yet another object of the present invention is to provide a housing having grooves for grasping tape.

Additional objects of the present invention will appear as the description proceeds.

The present invention overcomes the shortcomings of the prior art by providing a tape dispenser having a plurality of spindles that will hold various width tape rolls within a housing containing compartments for said tape rolls. The housing is comprised of a rigid material having a plurality of grooves on opposing walls of said housing for axially mounting spindles holding tape rolls therewith. There are serrated members extending therefrom said housing enabling tape to be sheared into any length needed.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
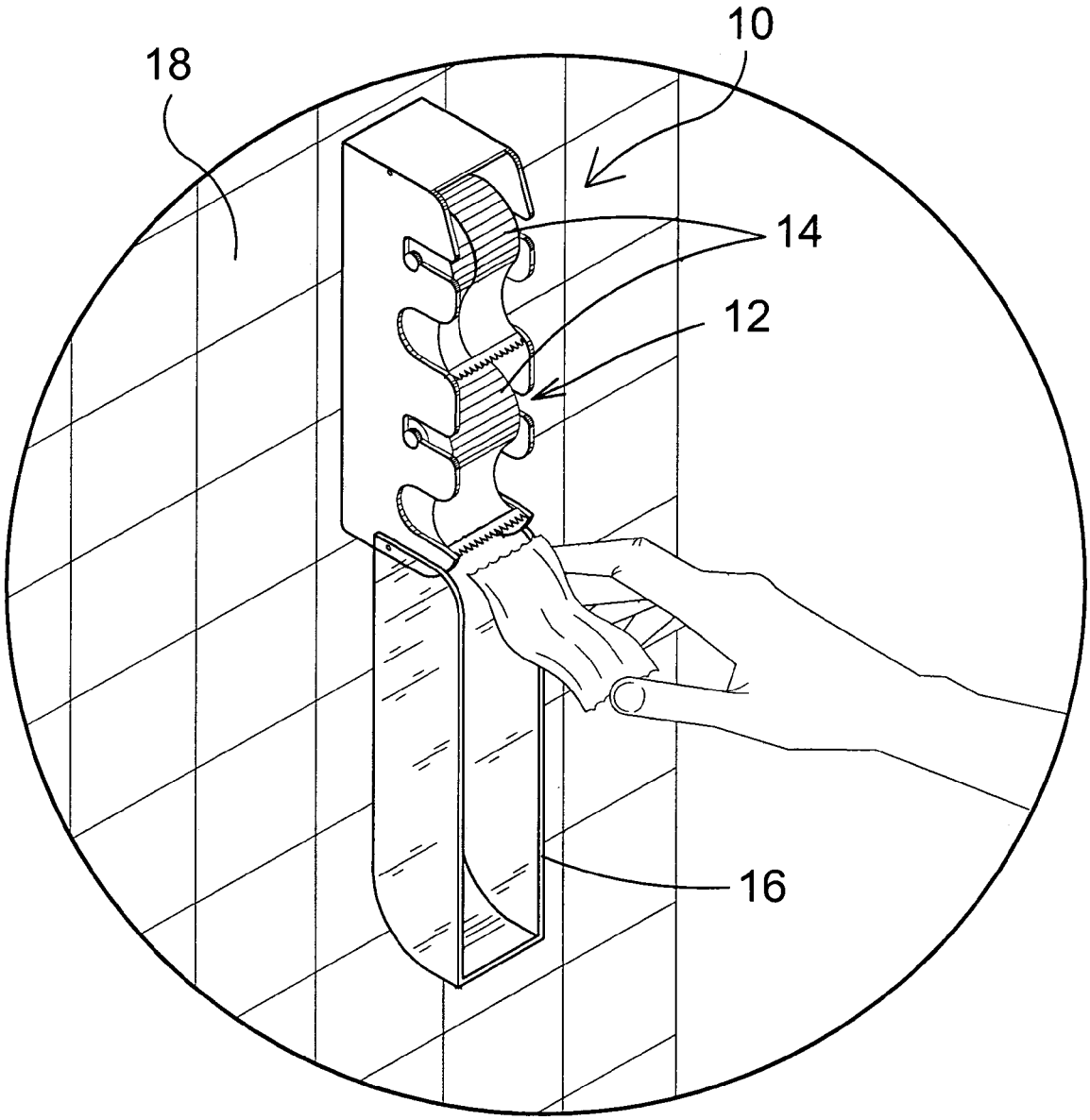
FIG. 1 is an illustrative view of the present invention.

With regard to reference numerals used, the following numbering is used throughout the drawings.

10 present invention
12 tape dispenser
14 tape roll
16 dust cover
18 wall
20 serrated edge
22 pivot point
24 locking element
26 spindles
28 groove
30 housing
32 spacer
34 finger notch
36 apertures

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10. Shown is a wall 18 to which is mounted a surgical tape dispenser 12 providing means for holding multiple rolls of tape 14 and having an anti contamination dust cover 16 for accessing tape or changing tape rolls.

Figure 2:
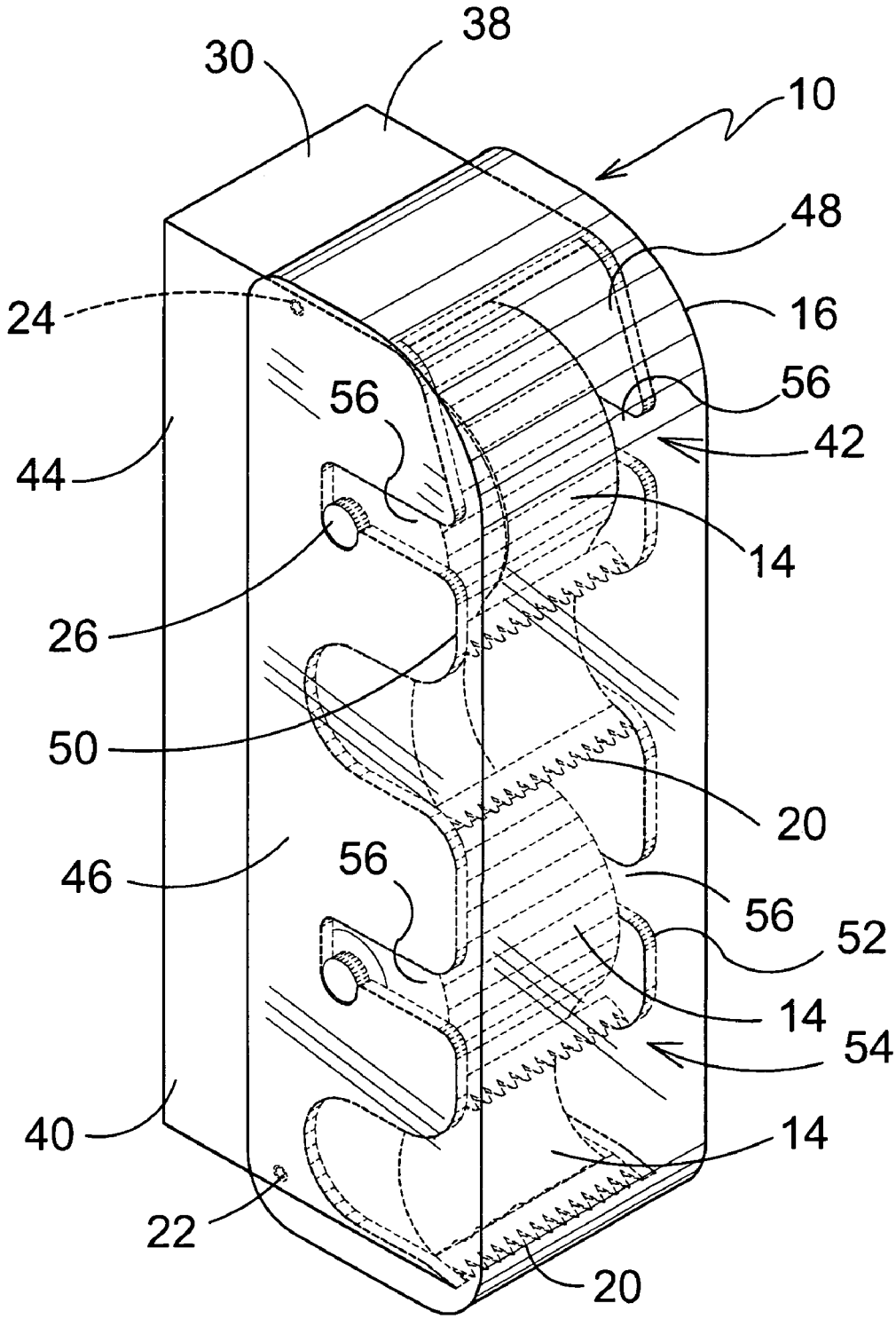
FIG. 2 is a perspective view of the present invention.

Turning to FIG. 2, shown therein is a perspective view of the present invention 10. Shown is the present invention 10 comprised of a housing 30 made of rigid material and able to receive a plurality of tape rolls 14 on including spindles 26 and having multiple serrated members 20 or cutting edges for shearing small or large amounts or pieces of tape from respective tape rolls 14. Also shown are dust cover 16 mounted pivotally at pivot point 22 on one end with a locking element at 24 on the other end. The housing includes top and bottom opposing ends 38 and 40, respectively, a front face 42 and a rear side 44. First and second opposing side walls 46 and 48, respectively, extend between the front face 42 and rear side. The first and second opposing side wall 46 and 48 each have a front edge 50 and 52, respectively. The rear side 44 includes a mounting surface and the front face is open. A cavity 54 is formed in the front face 42 and between the first and second opposing side walls 46 and 48 for receiving a plurality of rolls of tape 14 therein. A plurality of horizontal notches 56 are disposed on the front edge of each of walls. The notches 56 on the first and second opposing side walls are aligned with one another to form notch pairs. Each notch pair are spaced apart along the side walls from each other. Each notch has a downwardly disposed groove in a rear of each notch for removably securing an article therein.

Figure 3:
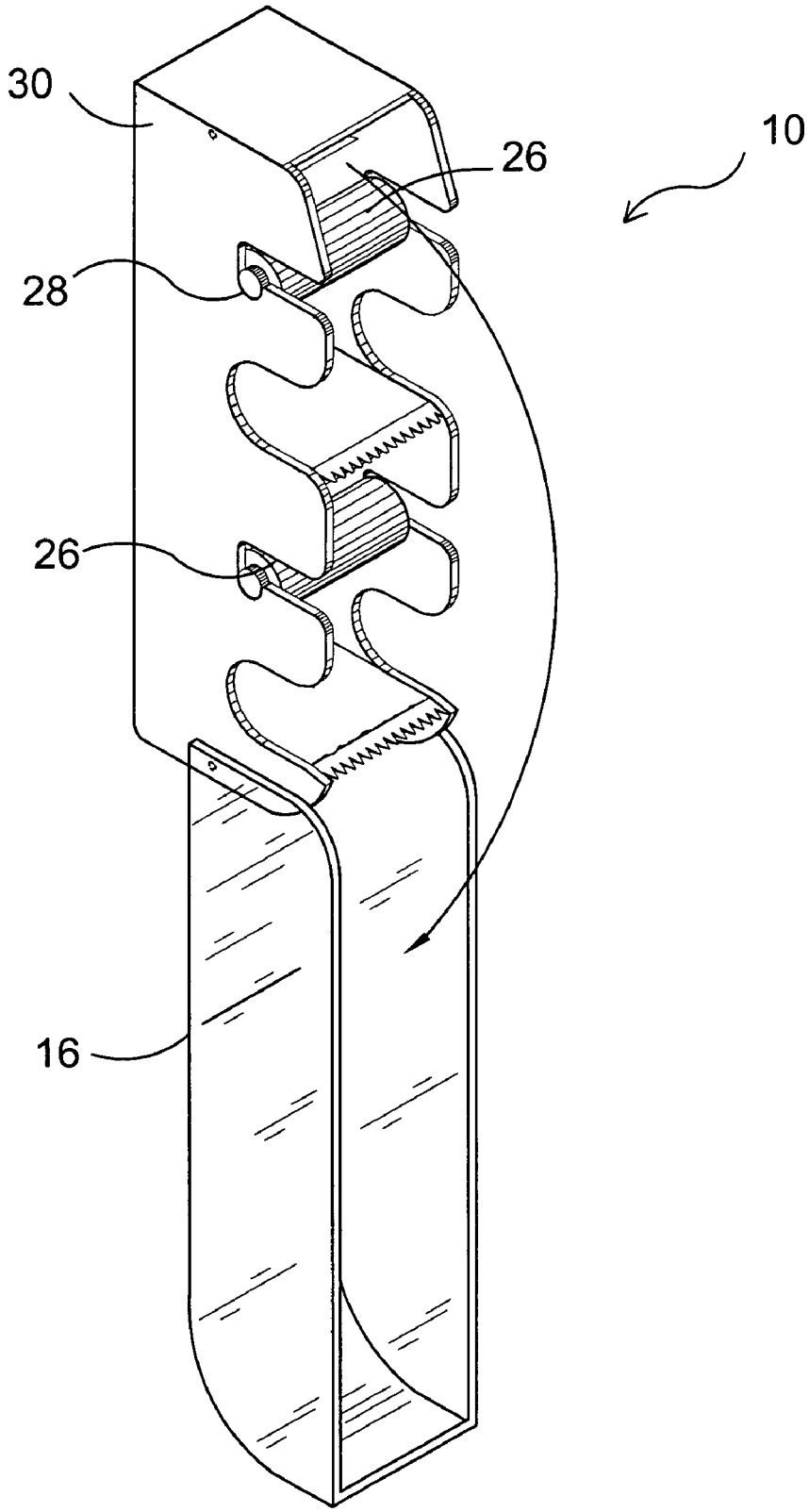
FIG. 3 is a perspective view of the present invention.

Turning to FIG. 3, shown therein is a perspective view of the present invention 10. Shown is the dust cover 16 pivoted downward leaving access for the removal of the tape spindles 26. The ends of the spindles 26 rotate within the grooves 28 of the rigid housing 30.

Figure 4:
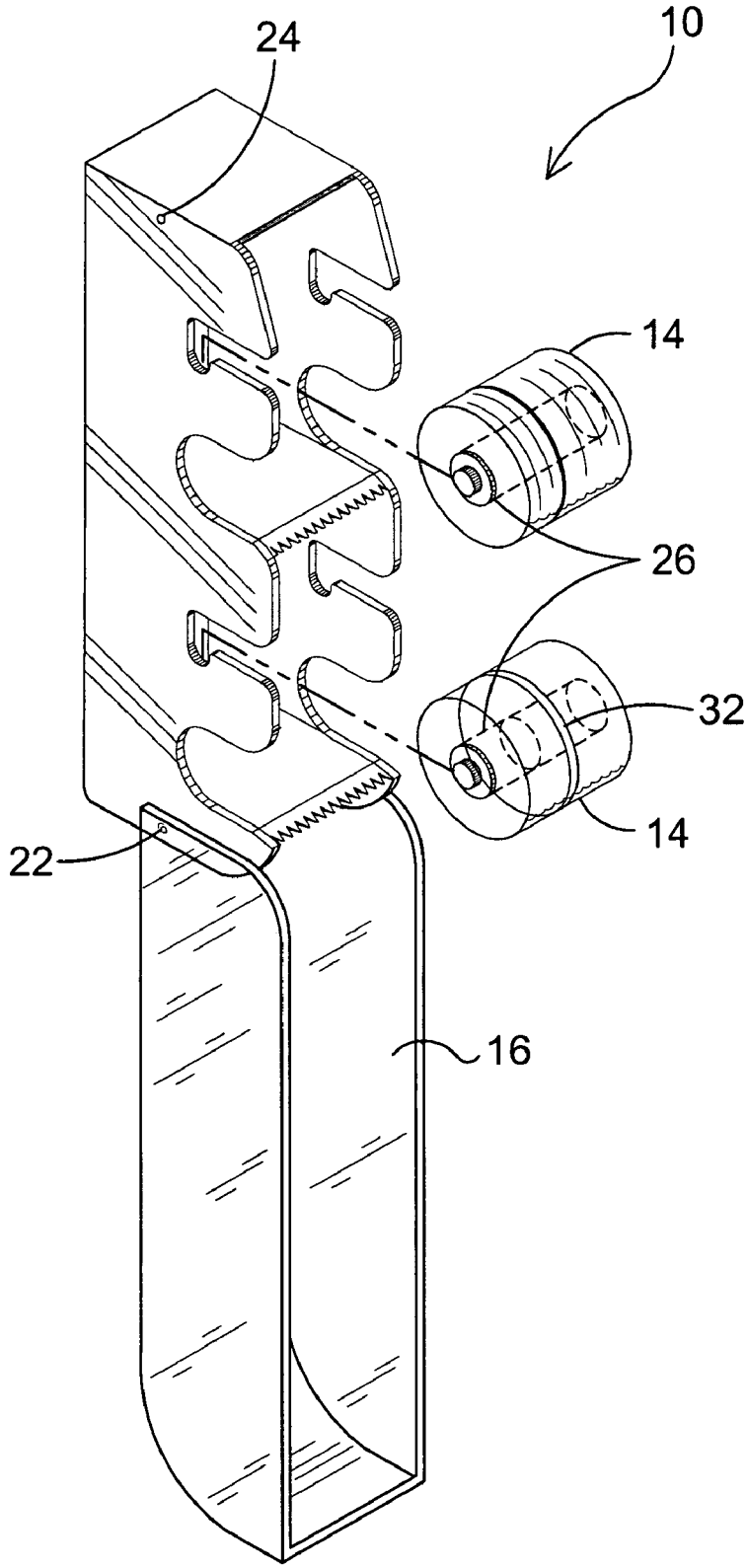
FIG. 4 is an exploded view of the present invention.

Turning to FIG. 4, shown therein is an exploded view of the present invention 10. Shown is the tape dispenser having a rigid multilevel tape roll support member with removable tape spindle 26 cores for holding a plurality of tape rolls 14. The dust cover 16 provides a contamination free environment for any type of tape including surgical tapes. Also shown are pivot 22, locking nub 24 and spacer 32.

Figure 5:
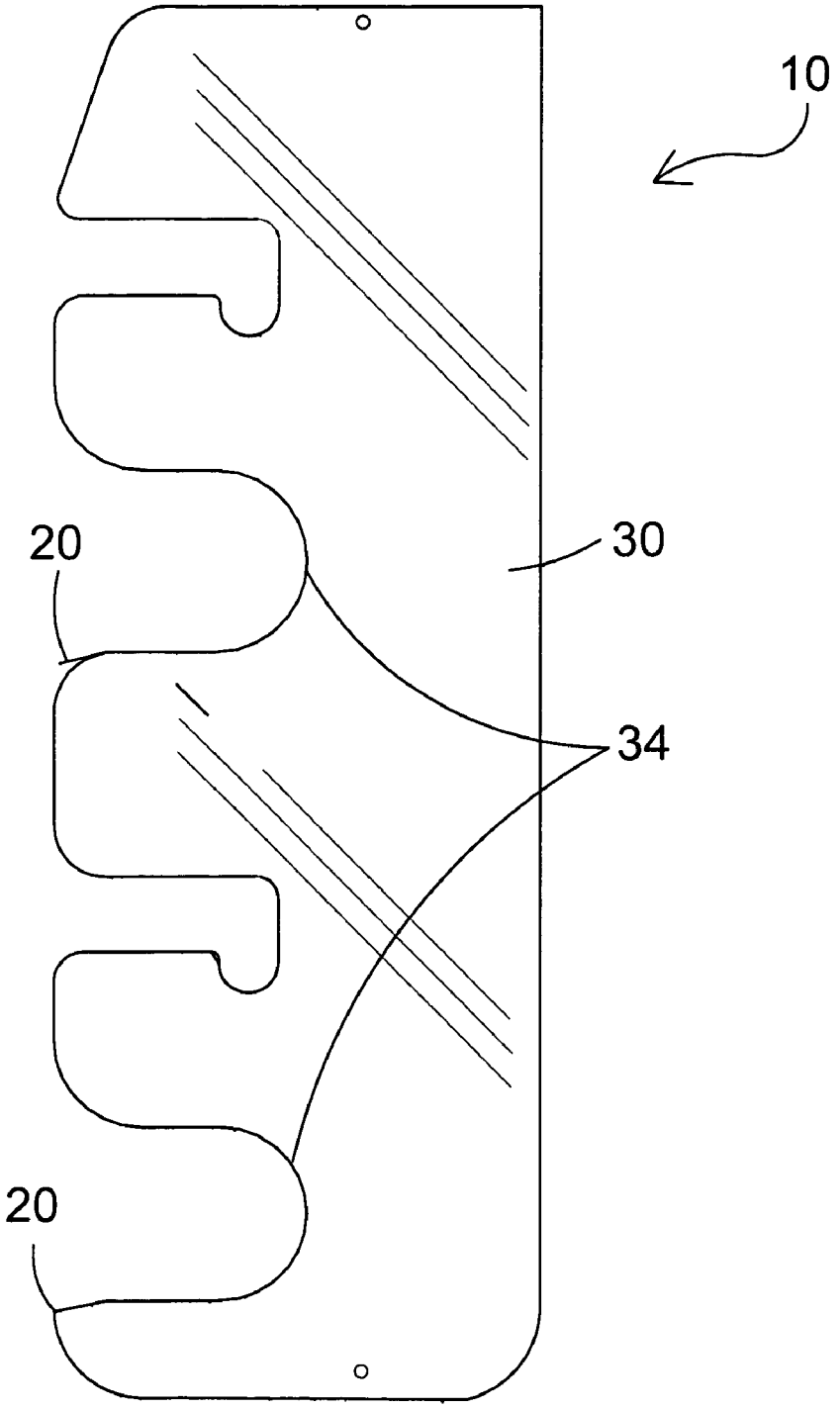
FIG. 5 is a side view of the present invention.

Turning to FIG. 5, shown therein is a side view of the present invention 10. Shown is the tape dispenser having serrated members 20 extending outward from the dispenser housing 30. The finger notches 34 within the dispenser housing 30 allow clearance for grasping the tape.

Figure 6:
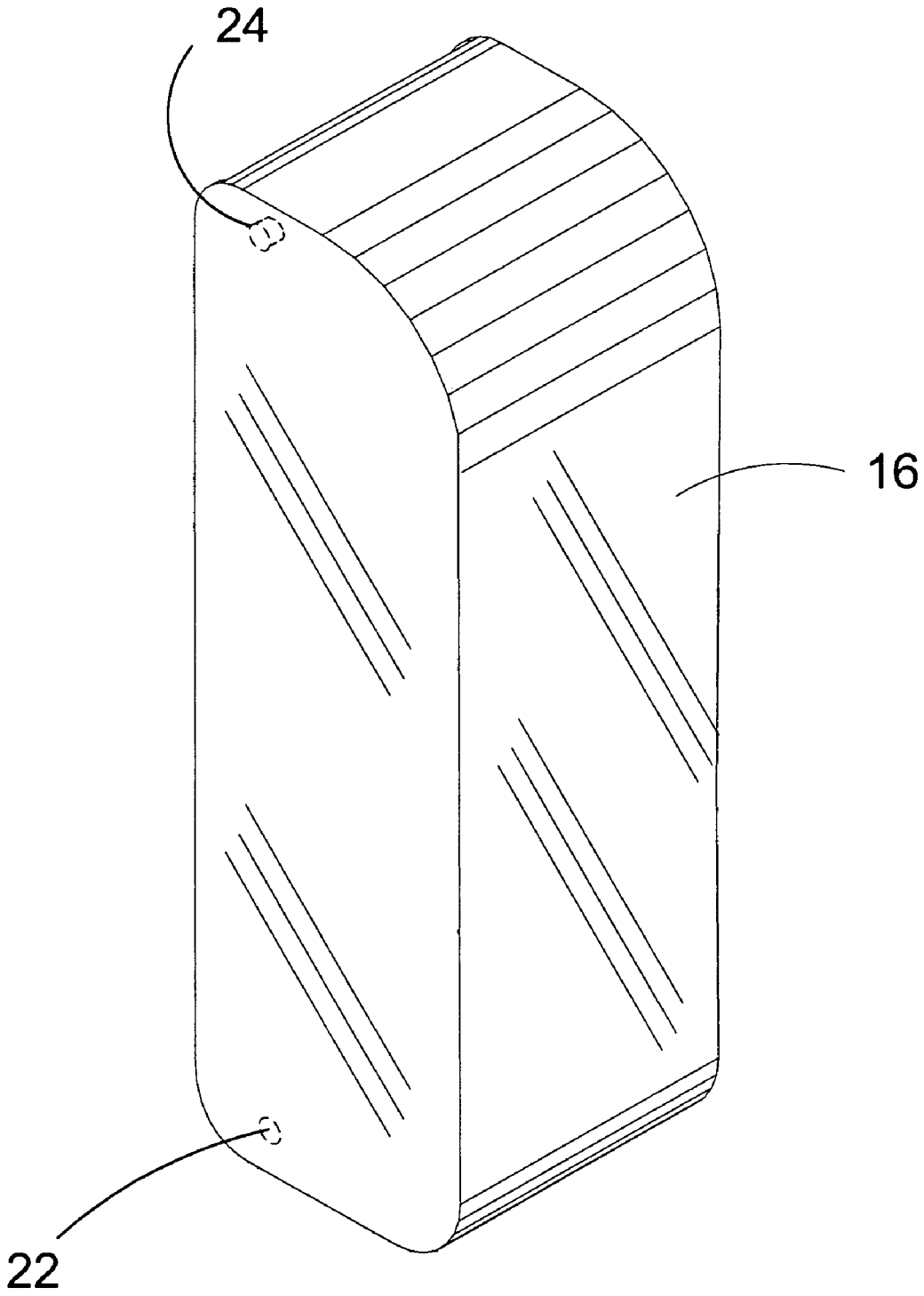
FIG. 6 is a perspective view of the dust cover of the present invention.

Turning to FIG. 6, shown therein is a perspective view of the dust cover 16 of the present invention. Shown is the dust cover 16 of the present invention comprising a rigid material having a pivot 22 at the bottom most end with a locking nub 24 located on the upper portion of the cover.

Figure 7:
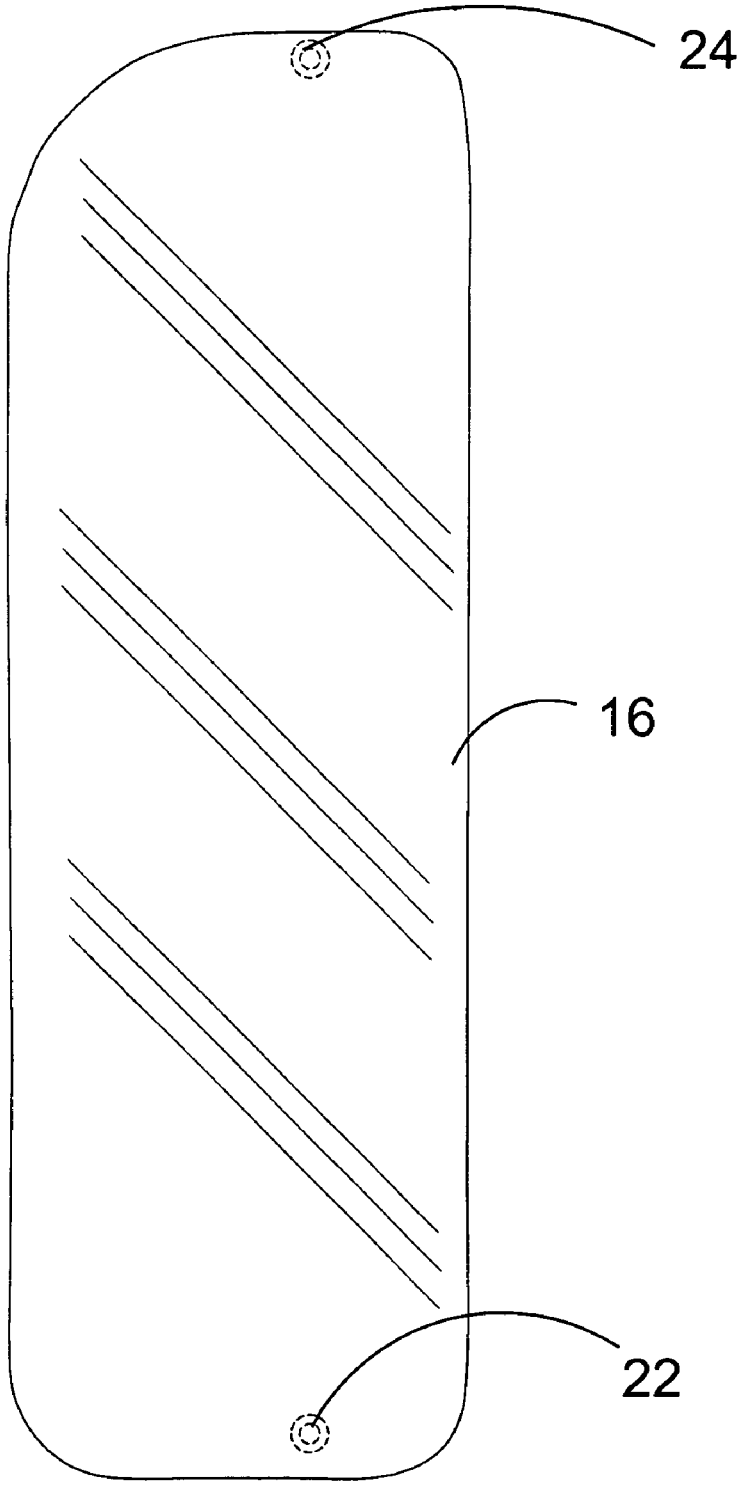
FIG. 7 is a side view of the dust cover of the present invention.

Turning to FIG. 7, shown therein is a side view of the dust cover 16 of the present invention. Shown is the dust cover 16 of the present invention comprising a rigid material having a pivot or nub 22 at the bottom end and a locking nub 24 located at the top portion of the device.

Figure 8:
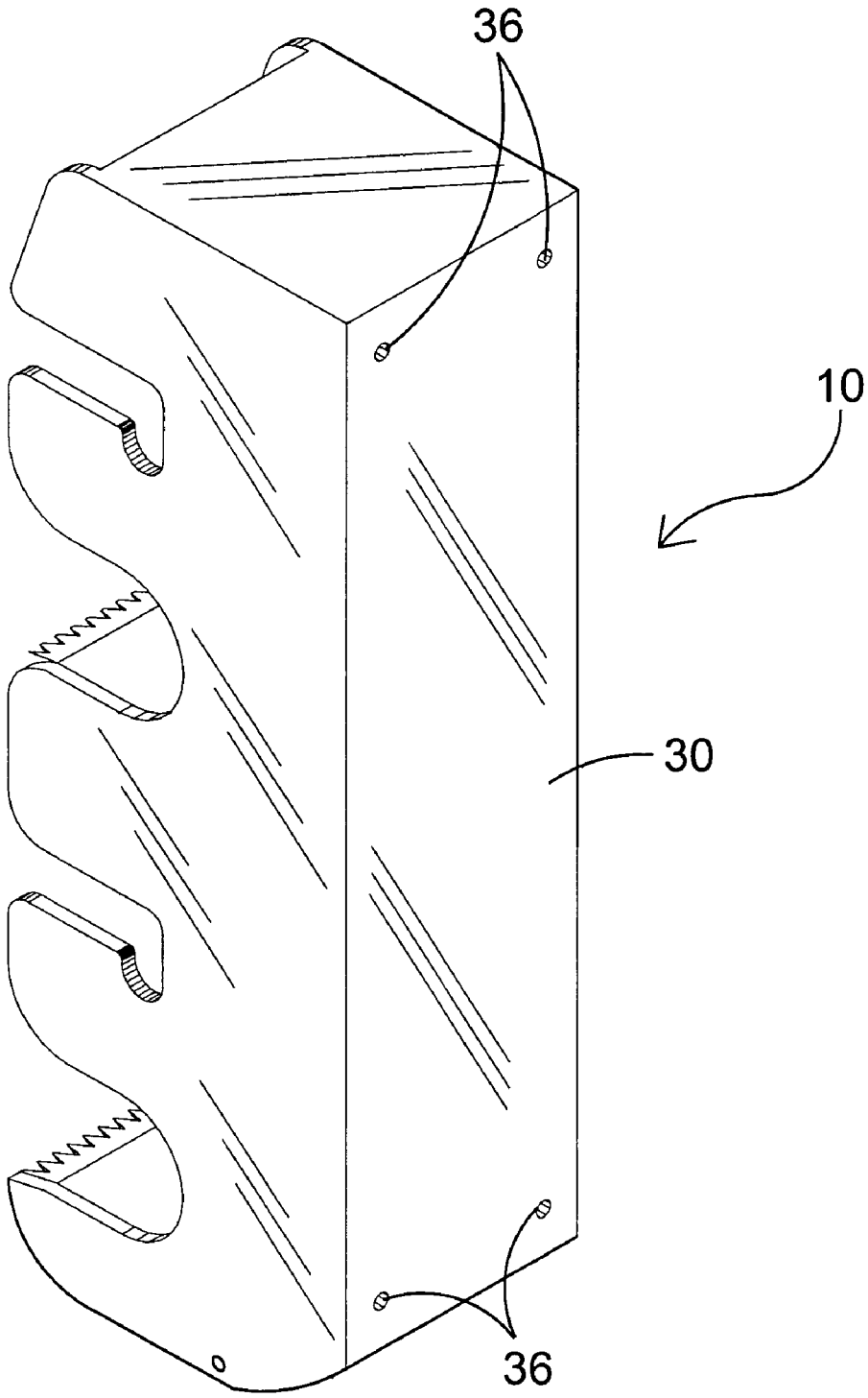
FIG. 8 is a back perspective view of the present invention.

Turning to FIG. 8, shown therein is a back perspective view of the present invention 10.

Shown are the multiple wall mounting apertures 36 within the housing 30 of the tape dispenser that will allow fasteners to pass therethrough for wall mounting.

I claim:

1. A tape dispenser for holding a plurality of rolls of tape, comprising:

a) a substantially rigid housing having a front face, a rear side, and a pair of opposing side walls extending between said front face and rear side, said opposing side walls each having a front edge, wherein said rear side comprises a rear surface and said front face is open forming a cavity therein between said opposing side walls for receiving a plurality of rolls of tape therein;

b) a plurality of horizontally disposed notches that are disposed on the front edge of each of said opposing side walls, said notches being spaced apart along said walls, wherein each notch disposed on a first one of said opposing side walls is aligned with a notch on a second one of said opposing side walls to form respective pairs of cooperatively aligned notches, each of said notches having a downwardly disposed groove disposed in a side thereof opposite the front edge; and c) a spindle for receiving a roll of tape thereon, said spindle having first and second opposing ends wherein a first end of said spindle is disposed in a first of a respective pair of grooves and a second end of said spindle is disposed in a second of said respective pair of grooves to permit the ends of the spindle to rotate in the grooves and to be removably secured in the grooves;

d) a plurality of serrated edges being disposed on a front of said housing adjacent each said pair of notches, wherein said serrated edges are substantially perpendicular to said side walls, wherein said serrated edges are positioned adjacent each of said pairs of notches to permit a piece of tape to be cut off of a roll of tape disposed in the tape dispenser;

e) a dust cover being disposed on said front of said housing so that said cover can be attached to the housing and then removed from the housing, wherein said dust cover has top and bottom opposing ends, wherein said bottom end is pivotally attached to a first end of said housing and said top end is releasably locked to a second end of said housing to permit the tape dispenser to be selectively covered by the dust cover, and said bottom end of said dust cover comprises a pivot disposed on said bottom of said wall of said housing and a locking nub disposed on said top of said wall of said housing; and f) finger notches disposed in said front edges of said sidewalls in a spaced apart manner adjacent the spindles to permit fingers of a user to grasp the tape.

2. The tape dispenser of claim 1, wherein said rear surface of said housing has a plurality of apertures therein, wherein said apertures are spaced apart to permit the housing to be attached to a wall by having fasteners pass through the apertures.

3. The tape dispenser of claim 2, wherein said housing is able to receive two rolls of tape therein.

4. The tape dispenser of claim 3, wherein said housing is able to receive three rolls of tape therein.

5. The tape dispenser of claim 3, further comprising a roll of tape being disposed on each of said plurality of spindles.

* * * * *